United States Patent [19]

Carney et al.

[11] 4,262,600

[45] Apr. 21, 1981

[54] TOWCART CONVEYOR SYSTEM

[75] Inventors: Edward J. Carney, Bloomfield Hills, Mich.; Harbans L. Mediratta, Windsor, Canada; Donald G. Heximer, Howell, Mich.

[73] Assignee: Acco Industries Inc., Trumbull, Conn.

[21] Appl. No.: 89,979

[22] Filed: Oct. 31, 1979

[51] Int. Cl.[3] ..... B61B 10/04

[52] U.S. Cl. ..... 104/172 BT; 104/140; 104/170

[58] Field of Search ..... 104/88, 140, 170, 172 R, 104/172 S, 172 BT

[56] References Cited

U.S. PATENT DOCUMENTS

| | | | |
|---|---|---|---|
| 2,965,043 | 12/1960 | Klamp et al. | 104/172 BT X |
| 3,015,284 | 1/1962 | Klamp | 104/172 BT |
| 3,495,547 | 2/1970 | Bishop | 104/172 BT |
| 3,503,338 | 3/1970 | Klamp | 104/172 BT |
| 3,973,503 | 8/1976 | Parker et al. | 104/172 BT |

*Primary Examiner*—Randolph A. Reese

*Attorney, Agent, or Firm*—Barnes, Kisselle, Raisch & Choate

[57] ABSTRACT

A towcart conveyor system comprising a conveyor movable below the floor surface and having a pusher, and a plurality of towcarts. Each towcart comprises a body movable along the floor surface and an upright member on the forward end of the body. A towpin support member is pivoted at its upper end adjacent the upper end of the upright member. A towpin is mounted on the support member and a combined spring and shock absorber assembly is interposed between the towpin support member and a portion of the body and is operable to absorb the shock of engagement of the pusher of the conveyor with the towpin and is operable to return the towpin support member and the towpin to its original position when the pusher becomes disengaged from the towpin.

12 Claims, 4 Drawing Figures

TOWCART CONVEYOR SYSTEM

This invention relates to conveyor systems and particularly to towcart conveyor systems.

BACKGROUND AND SUMMARY OF THE INVENTION

One common type of conveyor system utilized in handling materials comprises a wheeled towcart that is movable by engagement of a towpin thereon which extends through a slot in the floor into engagement with a conveyor movable beneath the floor. In use, it is common to disengage the towpin of the towcart and thereafter re-engage the towpin. When the conveyor chain with the pusher thereon engages the towpin, a shock occurs resulting in a jarring of the towcart and the contents thereon.

One type of system heretofore suggested is shown in U.S. Pat. No. 3,478,698 wherein the towpin is supported on a horizontal cylinder slidable beneath the tow truck and a shock absorber is provided between the cylinder and truck. Such a system is complex, costly, cannot be adjusted and is not readily accessible for service.

Among the objectives of the present invention are to provide an improved construction whereby the shock is absorbed; which construction is relatively simple and inexpensive, may be adapted to any load or speed, results in increased reliability of engagement of the towcart with the conveyor and is readily accessible for adjustment and service.

Basically, the invention comprises providing a towpin assembly that is pivoted above the body of the towcart at a point such that the movement of the towpin mounted on the towpin assembly is generally horizontal and a shock absorber assembly interposed between the assembly and a portion of the body of the towcart and engaging the towpin assembly to absorb the shock of engagement of the pusher of the conveyor chain with the towpin.

DESCRIPTION

Figure 1:
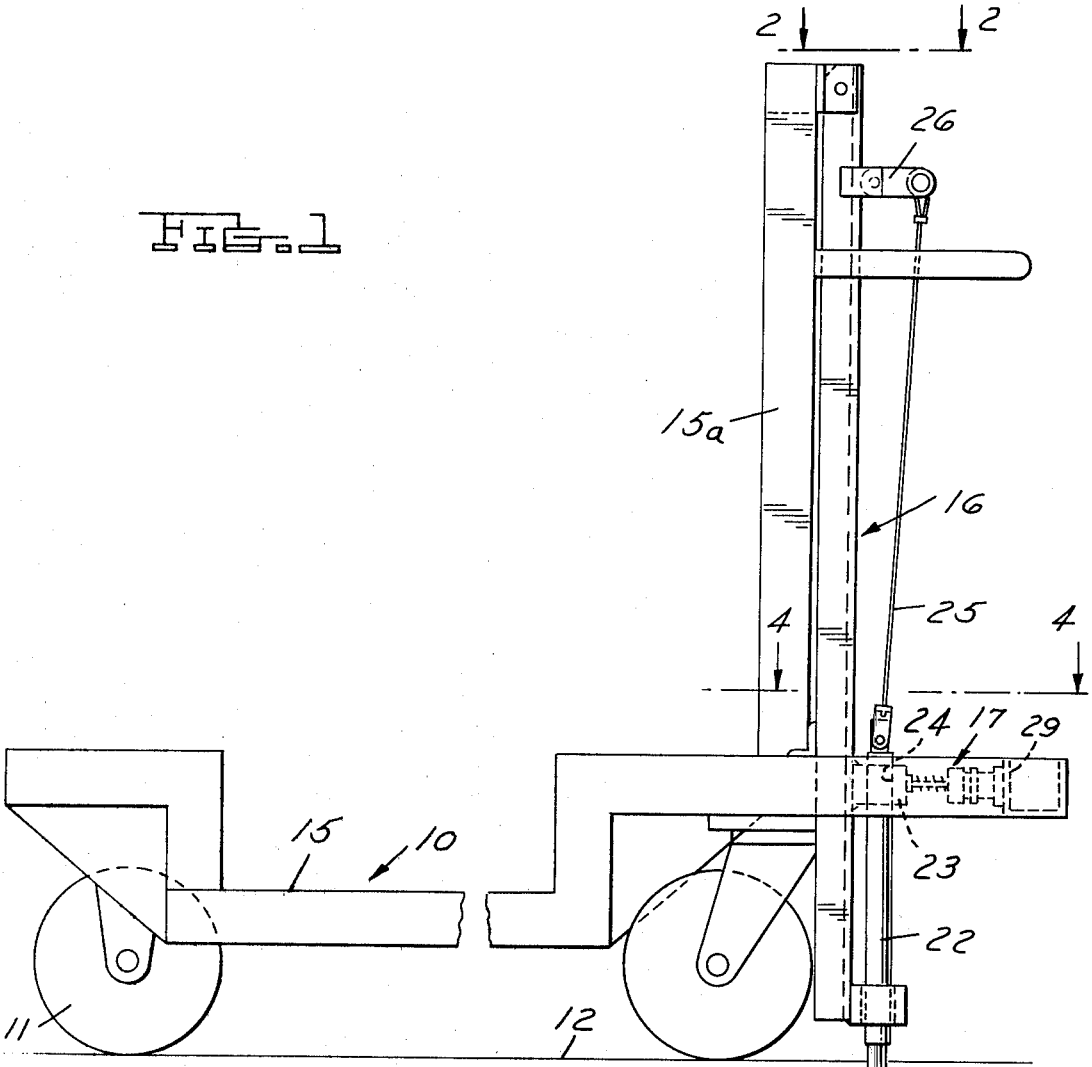
FIG. 1 is a fragmentary side elevational view of a conveyor system embodying the invention.
Figure 3:
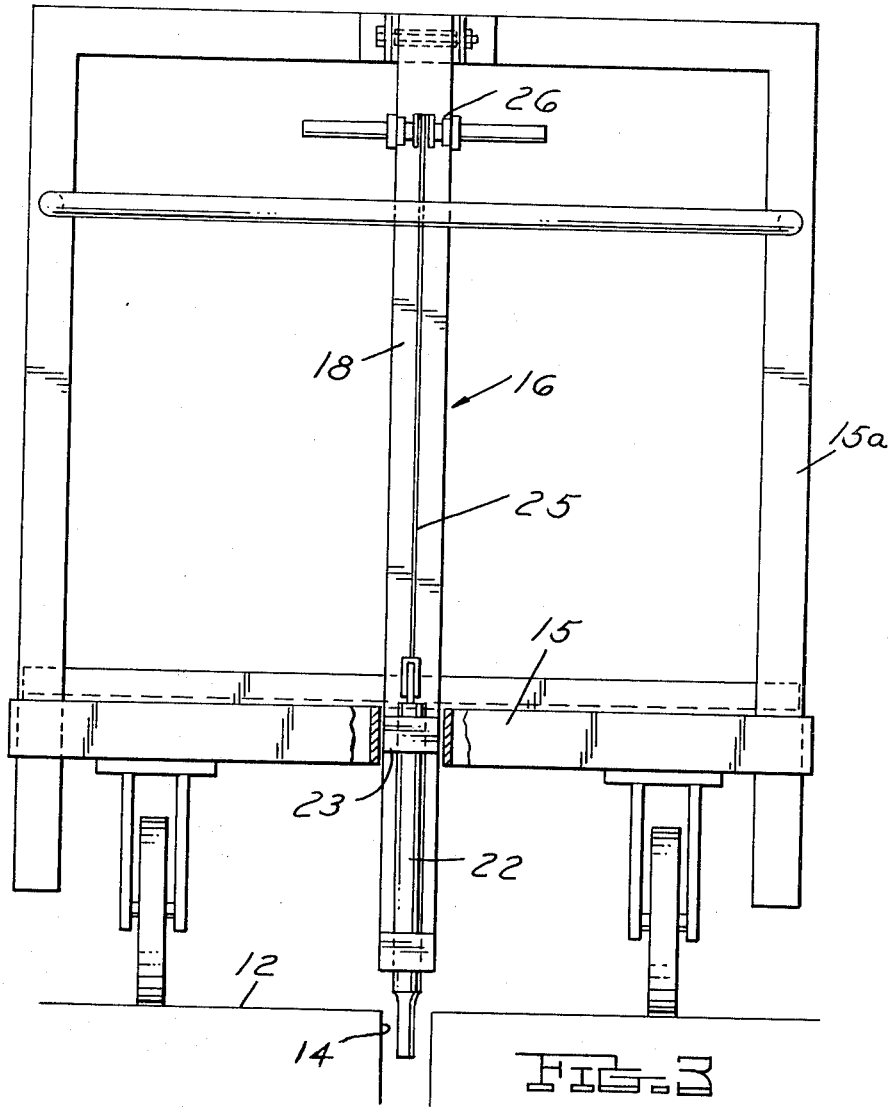
FIG. 3 is a front elevational view of the system shown in FIG. 1.

Referring to FIGS. 1 and 3, the conveyor system embodying the invention comprises a plurality of towcarts 10 having wheels 11 so that the towcarts can be moved along a floor 12. A conveyor including a plurality of pushers 13 is provided beneath a slot 14 in the floor.

Each towcart 10 includes a body 15 and an upright structural member **15*a*** in the form of an inverted U which functions as a hand rail, load retaining member and support for dispatch information. The aforementioned construction is conventional.

In accordance with the invention, a towpin assembly 16 is pivoted to the upper end of the upright 15 and a shock absorber assembly 17 is interposed between the towpin assembly 16 and a portion of the body 10 as presently described.

Figure 2:
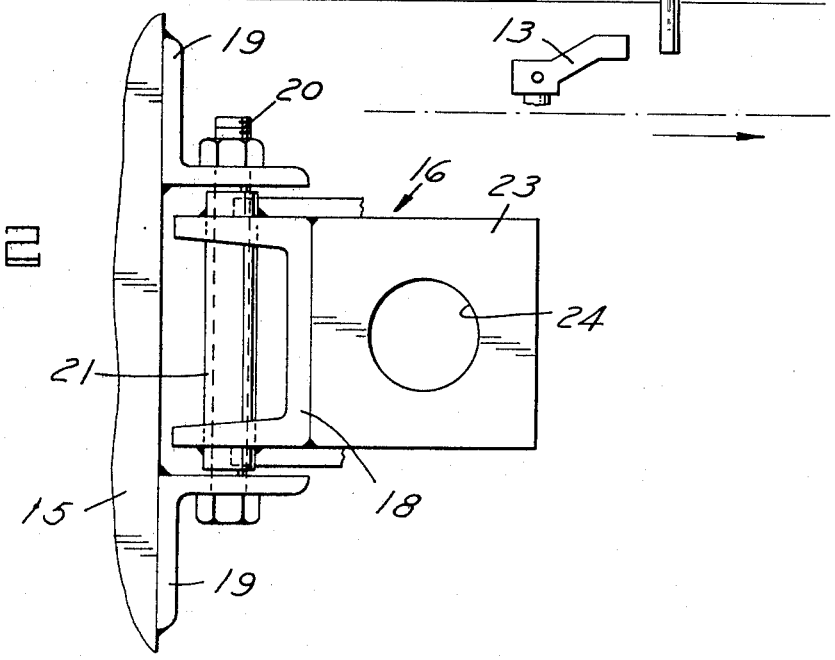
FIG. 2 is a fragmentary view on an enlarged scale taken along the line 2—2 in FIG. 1.
Figure 4:
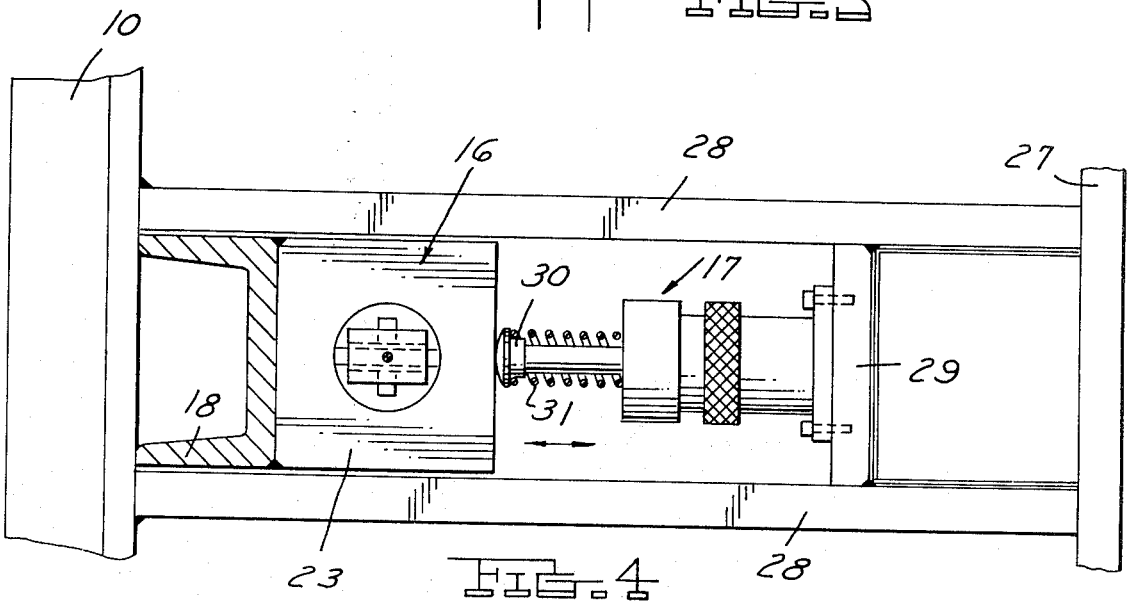
FIG. 4 is a fragmentary sectional view on an enlarged scale taken along the line 4—4 in FIG. 1.

As shown in FIGS. 2 and 4, towpin assembly 16 includes an upright structural member 18 in the form of a channel that is pivoted to angles 19 at the upper end of structural member 15 by a bolt 20 extending through a fixed sleeve 21 on the support member 18. A towpin 22 is supported for vertical movement on the support member 18 by spaced blocks 23, each having an opening 24 through which the towpin 22 extends. A cable 25 is fastened to the upper end of the towpin 22 and extends to a lever 26 that is mounted on the support member 18 and is movable manually to lift the towpin 22 through the cable 25 upwardly out of the slot 14.

As shown in FIG. 4, the body 15 of the cart 10 includes a fixed bumper 27 that is supported on the forward end of the body by spaced structural members 28 between which the towpin support member 18 extends. The shock absorber assembly 17 is supported on a transverse structural member 29 and has its actuator 30 extending rearwardly into engagement with the upper block 23 on support member 18.

The shock absorber assembly is of the dashpot type and includes a spring 31. The assembly is preferably of the linear deceleration type which dissipates kinetic energy at a uniform rate. In addition, the shock absorber is adjustable so that the amount of energy absorbed can be adjusted for the load and speed of the conveyor system. A satisfactory shock absorber assembly is of the hydraulic type sold by ACE Controls, Inc. of Farmington, MI under the designation model SAMS.

Such a shock absorber includes an inner tube having a plurality of holes along the length of the cylinder so that as the piston moves along the cylinder, it closes the holes one by one, decreasing the effective total area. As the energy of the load of the towpin decreases, a constant deceleration force is maintained. In order to adjust for varying loads and speeds, a slotted outer metering tube is provided over the inner tube so that the slotted tube can be rotated to adjust the total effective area.

Because of the length of member 18 of the towpin assembly 16, the portion of member 18 adjacent the actuator or plunger 30 of the shock absorber assembly moves in a substantially straight line. In other words, the cosine of the included angle through which member 18 moves is substantially 1.

It can thus be seen that there has been provided a simple, inexpensive system for absorbing the shock of engagement of the pusher of a conveyor with the towpin of a towcart. The system may be adapted to the load and speed, is reliable and is easily accessible for adjustment and service.

We claim:

1. A towcart conveyor system comprising a conveyor movable below a floor surface and having a pusher, a plurality of towcarts, each towcart comprising a body having wheels for movement along said floor surface, a towpin support assembly, means for pivoting at its upper end said towpin support assembly at a point spaced vertically above said cart such that the normal pivotal movement subtends a very small angle having a cosine of substantially one, said towpin support assembly including a towpin, and a combined spring and shock absorber assembly interposed between said towpin support assembly and a portion of said body forwardly of said towpin support assembly and operable to absorb the shock of engagement of said pusher of said conveyor with said towpin and operable to return said towpin support assembly and said towpin to its original position when the pusher becomes disengaged from said towpin.

2. The conveyor system set forth in claim 1 wherein said towcart has an upright extending structural member, said towpin support assembly comprising a vertically extending structural member pivoted to said structural member on said towcart and having the towpin mounted thereon.

3. The conveyor system set forth in claim 2 wherein said shock absorber is of the hydraulic linear deceleration type.

4. The conveyor system set forth in claim 3 wherein said towcart includes a bumper extending forwardly of said towcart, said shock absorber assembly being mounted on said body between said bumper and said towpin support assembly.

5. The conveyor system set forth in claim 3 wherein said towcart includes a bumper, structural members extending longitudinally and forwardly of said body and mounting said bumper on said body, said towpin assembly extending between such structural members, said shock absorber assembly being mounted between said structural members and engaging said towpin support assembly.

6. The conveyor system set forth in claim 1 wherein said spring and shock absorber assembly is of the type which can be adjusted while in position on the towcart.

7. For use in a conveyor system comprising a conveyor movable below a floor surface and having a pusher, a towcart comprising a body having wheels for movement along a floor surface, an upright member on the forward end of said body, a towpin support assembly, means for pivoting said towpin support assembly at a point spaced vertically above said cart such that the normal pivotal movement subtends a very small angle having a cosine of substantially one, said towpin support assembly including a towpin, and a combined spring and shock absorber assembly interposed between said towpin support assembly and a portion of said body forwardly of said towpin assembly and operable to absorb the shock of engagement of said pusher of said conveyor with said towpin and operable to return said towpin support assembly and said towpin to its original position when the pusher becomes disengaged from said towpin.

8. The towcart set forth in claim 7 wherein said towcart has an upright extending structural member, said towpin support assembly comprising a vertically extending structural member pivoted to said structural member on said towcart and having the towpin mounted thereon.

9. The towcart set forth in claim 8 wherein said shock absorber is of the hydraulic linear deceleration dashpot type.

10. The towcart set forth in claim 9 wherein said towcart includes a bumper extending forwardly of said towcart, said shock absorber assembly being mounted on said body between said bumper and said towpin support assembly.

11. The towcart set forth in claim 10 wherein said towcart includes a bumper, structural members extending longitudinally and forwardly of said body and mounting said bumper on said body, said towpin support assembly extending between such structural members, said shock absorber assembly being mounted between said structural members and engaging said towpin support assembly.

12. The towcart set forth in claim 7 wherein said spring and shock absorber assembly is of the type which can be adjusted while in position on the owcart.

* * * * *